US005134744A

United States Patent [19]

Ji

[11] Patent Number: 5,134,744

[45] Date of Patent: Aug. 4, 1992

[54] BEATER BRUSH ROLLER OF VACUUM CLEANER BEATER BRUSH ASSEMBLY

[75] Inventor: Heon Pyeong Ji, Seoul, Rep. of Korea

[73] Assignee: Goldstar Co., Ltd., Seoul, Rep. of Korea

[21] Appl. No.: 750,279

[22] Filed: Aug. 27, 1991

[30] Foreign Application Priority Data

Aug. 30, 1990 [KR] Rep. of Korea ..... 13248/1990

[51] Int. Cl.[5] ..... A46B 13/00

[52] U.S. Cl. ..... 15/179; 15/366

[58] Field of Search ..... 15/179, 181, 182, 183, 15/366

[56] References Cited

U.S. PATENT DOCUMENTS 1,815,077 7/1931 Shank ..... 15/179
1,815,084 7/1931 White ..... 15/366 X
1,975,567 10/1934 Dossmann ..... 15/179

FOREIGN PATENT DOCUMENTS 2229196 12/1974 France ..... 15/366

*Primary Examiner*—Chris K. Moore
*Attorney, Agent, or Firm*—Brumbaugh, Graves, Donohue & Raymond

[57] ABSTRACT

A beater brush roller of a vacuum cleaner beater brush assembly comprising a body assembly including a semi-cylindrical brush body having a helical brush strip integrally provided therewith, a semi-cylindrical beater body including a helical beater strip integrally provided therewith, a pair of axles engaging with bearing mounts of the beater brush assembly for supporting rotation of the beater brush roller. The annular supports are integrally provided to the body assembly for supporting the axles at opposite ends of the body assembly. The brush body, the beater body and the axles engage with a pair of set screws at the same time, thereby accomplishing the beater brush roller. The present invention provides a beater brush roller of a vacuum cleaner beater brush assembly having advantages in that it accomplishes the simple structure and facilitating the assembling thereof, and the fixing of the axles thereof is more facilitated and the crack of the roller body due to the fitting force is prevented.

3 Claims, 4 Drawing Sheets

BEATER BRUSH ROLLER OF VACUUM CLEANER BEATER BRUSH ASSEMBLY

BACKGROUND OF THE INVENTION

The present invention relates to a vacuum cleaner beater brush assembly provided at a nozzle of a vacuum cleaner, and more particularly to a vacuum cleaner beater brush roller of the beater brush assembly having the simple structure capable of facilitating the assembling thereof and preventing a damage, such as a crack, of the roller during fitting the rotating axles thereto.

Conventionally, a vacuum cleaner comprises, as shown in FIG. 1, a main body 1 having a chamber for collecting dirt, a suction nozzle 4 for sucking the dirt therethrough, a flexible hose 2 connected to a connector of the main body 1, a pipe 3 or a handle connected to the suction nozzle 4, said hose 2 and said pipe 3 connected to each other and adapted for guiding the dirt, having sucked by the nozzle 4 from the surface being cleaned, to the main body 1.

As shown in FIG. 2 which is an exploded perspective view representing the structure of a nozzle of a vacuum cleaner in accordance with the prior art, the suction nozzle 4 generally comprises a bottom casing 5, and a rotatable beater brush assembly 6 rotatably mounted to the bottom casing 5 and adapted for agitating the surface being cleaned, such as a carpet or the like, for improved removal of dirt therefrom. A drive motor 8 is mounted to the bottom casing 5 at a back position spaced apart from the beater brush assembly 6 for generating power for driving the beater brush assembly 6, and a cog belt or timing belt 7 is disposed in order to connect the beater brush assembly 6 to the drive motor 8 so that the driving power is transmitted form the drive motor 8 to the beater brush assembly 6. The suction nozzle 4 is also provided with an air guider 9 for guiding the air including dirt having sucked by the nozzle 4, a spring 10 for controlling the height, a connector 11 rotatably mounted to the air guider 9 in order to be connected to a free end of the pipe 3 so that the air including dirt having sucked by the nozzle 4 is guided to the pipe 3 thereby. A bumper 12 is provided to the nozzle 4 for absorbing the outside shock, and an electric switch 13 for switching the electric power for driving the drive motor 8. There is provided in the nozzle 4 an upper casing 14 mounted onto the bottom casing 5 in order to cover the enclosures enclosed in the casing provided by the upper and bottom casings 5 and 14, a switching button 15 connected to the switch 13 and adapted to be pushed by the operator for switching the switch 13, a cover 16 for covering the upper casing 14, and an electric code 17 for supplying electric power from the outside power source to the drive motor 8 by way of the switch 13.

Among the above elements of the nozzle 4, the rotating beater brush assembly 6 which is related to the present invention is generally provided with a helical brush strip having a plurality of brush elements or brush bundles and a helical beater strip having a plurality of rigid beater projections, both strips adapted for agitating the surface being cleaned such as a carpet, for improved removal of dirt therefrom.

A representative example of such a beater brush assembly combined with a nozzle of a vacuum cleaner is that disclosed in John B. Lyman U.S. Pat. No. 4,429,430 which is referred to this invention in conjunction with the drawings, FIGS. 2 to 4. As shown in the drawings, the rotatable beater brush assembly 6 is provided with a rotatable cylindrical dowel or roller 20. The roller 20 carries a plurality of helical undercut channels 21 and 21' formed on the circumferential surface thereof in order to each receive a brush strip 23 and a beater strip 25 therein. The brush strip 23 has a plurality of brush bundles 22 secured thereto and spaced apart from each other for agitating the surface being cleaned such as a carpet upon rotation of the beater brush assembly 6. Also, the beater strip 25 comprises a plurality of relatively rigid projections 24 which are engaged with the surface being cleaned upon rotation of the beater brush assembly 6. The undercut channels 21 and 21', the brush strip 23 and the beater strip 23, both strips received in said undercut channels 21 and 21', are provided with complementary cross sections for retention in the channels 21 and 21' against centrifugal forces developed in rotation of the roller 20 about the axis thereof.

Also, the beater brush roller 20 is generally manufactured by relatively high strength maples, a kind of gingkos, and provided with a pair of rotating axles 26 and 26' inserted into opposite ends thereof in order to project therefrom and support the rotation thereof. Each of the rotating axles 26 and 26' is provided with a knurling machined portion 26*a*, 26'*a* at a center thereof, respectively, so that the axles 26 and 26' are fixed to the roller 20 not to move with respect to the roller 20 by virtue of the knurling machined portions 26*a* and 26'*a* thereof on fitting to opposite ends of the roller 20.

Furthermore, the rotatable beater brush assembly 6 has a support pulley 27 engaging with an end of the roller 20 in order to closely face thereto. The other end of the roller 20 engages with a sprocket comprising a first portion or ring flange 28 closely connected to one end of the roller 20 and having a belt retaining flange, and a second portion or gear pulley 29 engaging with the ring flange 28 and having teeth formed integrally therewith for engaging with the timing belt 7 so that the beater brush roller 20 is driven to rotate by virtue of rotation of the gear pulley 29.

An edge brush assembly 31 is provided outboard of the gear pulley 29 and includes a plurality of brush tufts 30 and an integral beater bar on the circumferential surface thereof, respectively. The brush assembly 31 is secured to the other end of the roller 20 by means of a pair of set screws 32, under the condition that the ring flange 28 and the gear pulley 29 are interposed between the brush assembly 31 and the roller 20, respectively. Also, a pair of bearing mounts 34 and 34' having an oil-filled bronze sleeve bearing, respectively, engage with the axles 26 and 26' at the opposite ends of the roller 20 in order to rotatably support the rotation of the roller 20, and a pair of washers 33 and 33' are interposed between both ends of the roller 20 and the bearing mounts 34 and 34'.

In assembling the above beater brush assembly 6, the support pulley 27 and the ring flange 28 are first fixed to the opposite ends of the roller 20. Thereafter, one bearing mount 34' is connected to the end of the roller 20 by fitting the axle 26' of the roller 20 into the oil-filled sleeve bearing of the bearing mount 34' under the condition that the washer 33' is disposed between the front end of the sleeve bearing of the bearing mount 34' and the depressed side surface of the end of the roller 20, while the gear pulley 29 and the edge brush assembly 31 are sequentially inserted onto the projection of the other axle 26 onto which the ring flange 28 has been mounted. Then, the gear pulley 29 and the assembly 31 are secured to the other end of the roller 20 by means of the screws 32. The other bearing mount 34 is then connected to the other end of the roller 20 by fitting the axle 26 of the roller 20 into the oil-filled sleeve bearing of the bearing mount 34.

In accordance, the above rotatable beater brush assembly 6 rotates by means of the drive force transmitted from the drive motor 8 to the gear pulley 29 by way of the timing belt 7, thereby allowing the brush bundles 23 of the brush strip 23 and the rigid projections of the beater strip 25 provided on the circumferential of the roller 20 to agitate the surface being cleaned, such as a carpet or the like, for improved removal of dirt therefrom.

Also, rotation of the edge brush assembly 31 accompanies the rotation of the roller 20 so that the brush tufts 30 and the integral beater bar provided on the circumferential surface of the assembly 31 efficiently agitate the edge of the surface being cleaned, for improved removal of dirt.

However, this type of beater brush roller has disadvantages in that it comprises a cylindrical body provided with the undercut channels 21 and 21' on the circumferential surface thereof each for receiving the brush strip 23 having the brush bundle 22 or the beater strip 25 having the rigid projections 24, so that it has the relatively complex structure resulting in difficulty of the assembling thereof, also a lengthwise crack of the roller 20, made of the relatively high strength maples, easily occurs in fitting portions thereof, at which the axles 26 and 26' are forcedly fitted thereto in order to prevent from moving with respect to the roller 20 by means of the knurling machined portions of the axles 26 and 26', the crack of the roller 20 is due to the forced fitting power.

SUMMARY OF THE INVENTION

It is, therefore, an object of the present invention to provide a beater brush roller of a vacuum cleaner beater brush assembly by which the above disadvantages can be overcome and which comprises two semi-cylindrical parts, a semi-cylindrical brush body integrally provided with brush strip including a plurality of brush bundles and a semi-cylindrical beater body integrally provided with a beater strip including a plurality of rigid projections, thereby causing the structure thereof to be more simple and the assembling thereof to be more facilitated and to be carried out more fast.

It is another object of the present invention to provide a beater brush roller of a vacuum cleaner beater brush assembly in which the axles are naturally secured to opposite ends thereof without giving any forced fitting force to the roller in assembling of the brush body and the beater body so that the crack does not occur at the fitting portions of the roller.

The above objects of the present invention can be accomplished by providing a beater brush roller of a vacuum cleaner beater brush assembly comprising: a body assembly comprising: a semi-cylindrical brush body including a helical brush strip integrally provided on a circumferential surface thereof, said brush strip including a plurality of brush bundles; and a semi-cylindrical beater body including a helical beater strip integrally provided on a circumferential surface thereof, said beater strip including a plurality of rigid beater projections; a pair of axles engaging with bearing mounts of said beater brush assembly for supporting rotation of said beater brush roller, aid axles mounted to opposite ends of said body assembly under the condition that it is prevented from moving with respect to said body assembly; means for supporting said axles at opposite ends of said body assembly, said means integrally formed with said brush body and said beater body; and means for combining said brush body with said beater body in order to accomplish said body assembly, said axles disposed between said brush body and said beater body and said means for combining said brush body and said beater body engaging with said axles at respective rear ends of said axles.

BRIEF DESCRIPTION OF THE DRAWINGS

The above and other objects, features nd other advantages of the present invention will be more clearly understood from the following detailed description taken in conjunction with the accompanying drawings, in which.

DETAILED DESCRIPTION OF THE PREFERRED EMBODIMENTS

Figure 5:
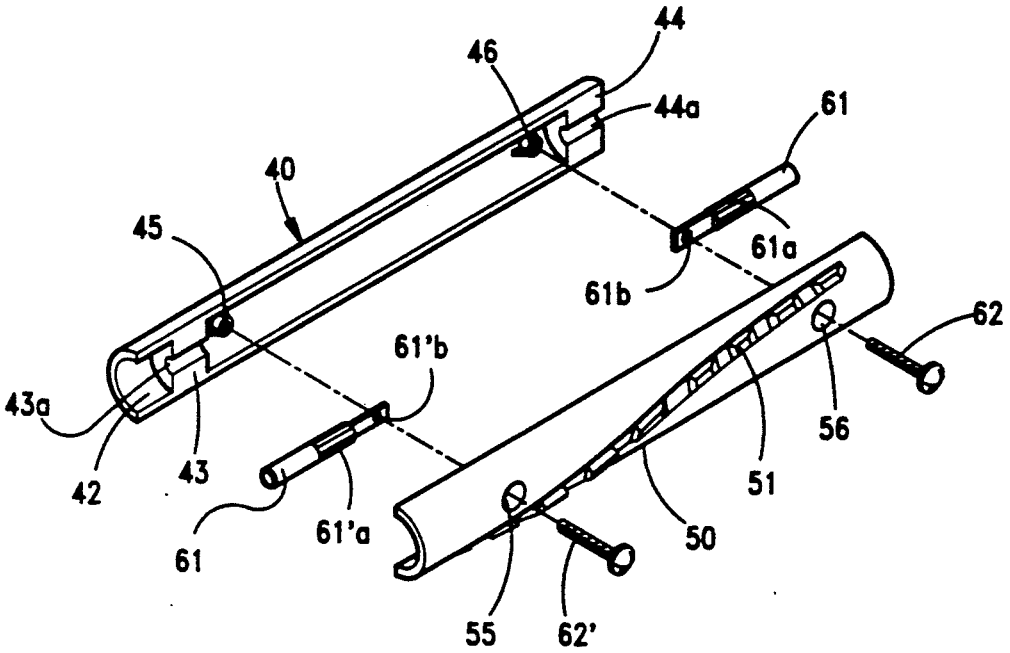
FIG. 5 is a view corresponding to FIG. 3, but showing the present invention.
Figure 6:
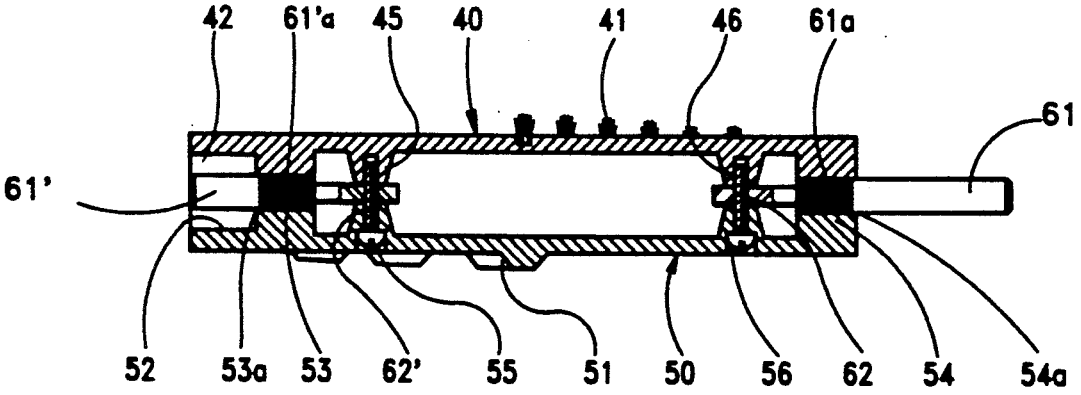
FIG. 6 is a view corresponding to FIG. 4, but showing the present invention.

Referring now to FIG. 5 which is an exploded perspective view representing the structure of a vacuum cleaner beater brush roller in accordance with this invention, and FIG. 6 which is a longitudinal sectioned view of the beater brush roller of FIG. 5 after assembling, the beater brush roller comprises a beater assembly comprising a semi-cylindrical brush body 40 and a semi-cylindrical beater body 50, and a pair of axles 61 and 61' mounted to opposite ends of the body assembly by means of annular supports integrally formed with the bodies.

The brush body 40 is provided with a helical brush strip including a plurality of brush bundles 41 and integrally formed on the circumferential surface thereof. Also, the brush body 40 includes a reduced inner diameter portion having a width and integrally formed therewith at a position of a distance from an end thereof so that the body 40 has a semi-cylindrical depression 42 and an annular support 43, while the brush body 40 includes, at the other end thereof, the other annular support 44 of reduced inner diameter portion having the same shape as that of the annular support 43. A pair of inner threaded bosses 45 and 46, for engaging with a set screws 62 and 62' for assembling the bodies 40 and 50 with each other in order to constitute the body assembly, is integrally provided as radially projecting from the inner surface of the brush body 40 at positions spaced apart from the annular supports 43 and 44, respectively.

On the other hand, the beater body 50 has on the surface thereof a helical beater strip including a plurality of rigid beater projections 51 and integrally formed therewith. In the same manner as that of the brush body 40, the beater body 50 includes a reduced inner diameter portion having a width and integrally formed therewith at a position of a distance from an end thereof so that the body 50 has a semi-cylindrical depression 52 and an annular support 53, while the brush body 50 includes, at the other end thereof, the other annular support 54 of reduced inner diameter portion having the same shape as that of the annular support 43. The annular supports 53 and 54 are provided at positions which correspond to the positions at which the annular supports 43 and 44 are provided. Also, a pair of inner threaded bosses 55 and 56, for engaging with the set screws 62 and 62', is integrally provided as radially projecting from the inner surface of the beater body 50 at positions spaced apart from the annular supports 53 and 54, respectively.

Each annular support 43, 44, 53, 54 has a semi-circular groove 43*a*, 44*a*, 53*a*, 54*a* adapted to fixedly receive the axles 61 and 61'. Each axle 61, 61' is provided with a knurling machined portion 61*a*, 61'*a* at a center thereof, the knurling machined portion 61*a*, 61'*a* engages with the groove 43*a*, 44*a*, 53*a*, 54*a* in order to fix the axle 61, 61', thereby causing the axles 61 and 61' not to move with respect to the bodies 40 and 50.

The axle 61, 61' is provided with a hole 61*b*, 61'*b* at a rear end thereof. The axles 61 and 61' are, in assembling the beater brush roller, arranged to the bodies 40 and 50 so that the holes 61*b* and 61'*b* communicate with the bosses 45, 46, 55 and 56 for allowing the set screws 62 and 62' to engage with the bosses 55 and 56 of the beater body 50, the holes 61*b* and 61'*b* and the bosses 45 and 46 of the brush body 50 at the same time.

In assembling, the axles 61 and 61' are first seated in the grooves 43*a* and 44*a* of the annular supports 43 and 44 so that the holes 61*b* and 61' thereof communicate with the inner threaded holes of the bosses 45 and 46 of the body 40, respectively. The whole contact surface of the brush body 40 and the beater body 50 are then applied with adhesive, and the beater body 50 forcedly adheres to the brush body 40 by means of the contact surface having applied with adhesive. Thereafter, the set screws 62 and 62' engage with the bosses 55 and 56 of the beater body 50, the holes of the axles 61 and 61' and the bosses 45 and 46 of the brush body 40, sequentially, thereby accomplishing the assembling of the roller.

Figure 1:
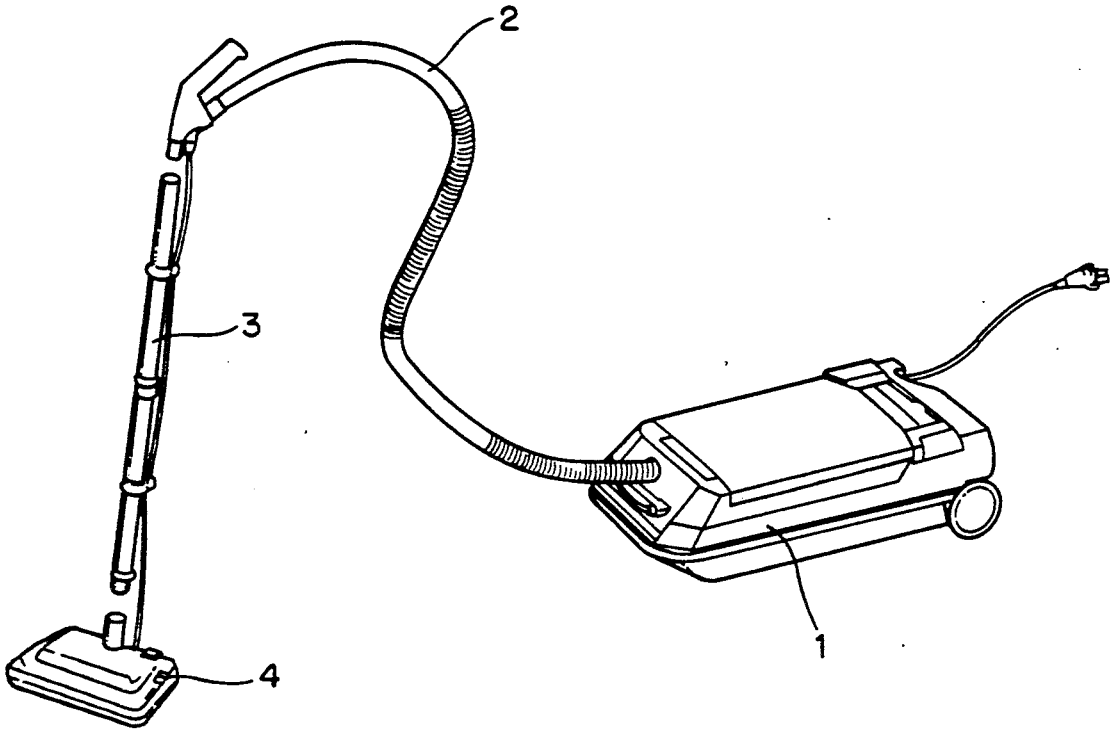
FIG. 1 PRIOR ART
FIG. 1 is a perspective view representing a general type vacuum cleaner.
Figure 2:
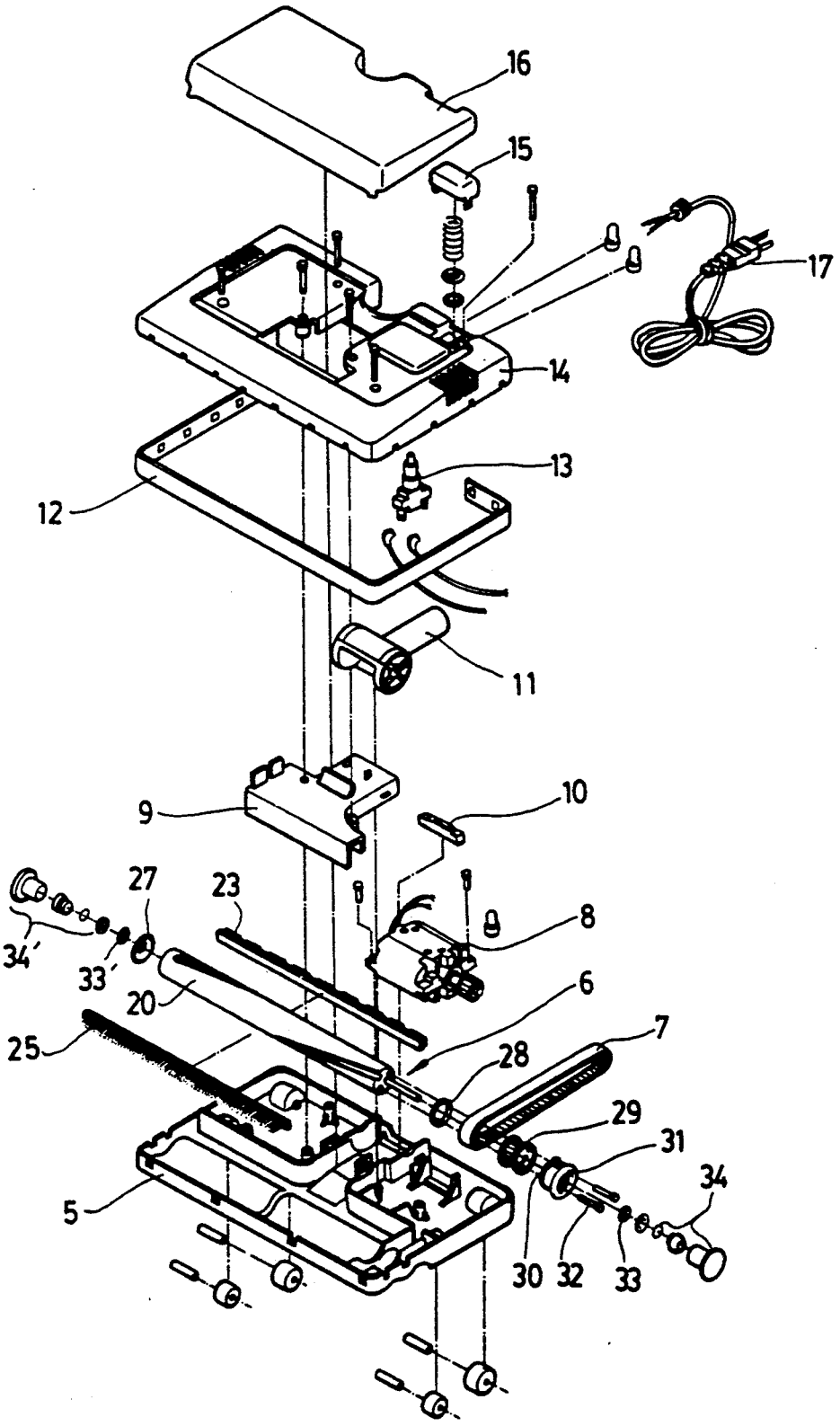
FIG. 2 PRIOR ART
FIG. 2 is an exploded perspective view representing the structure of a nozzle of a vacuum cleaner in accordance with the prior art.
Figure 3:
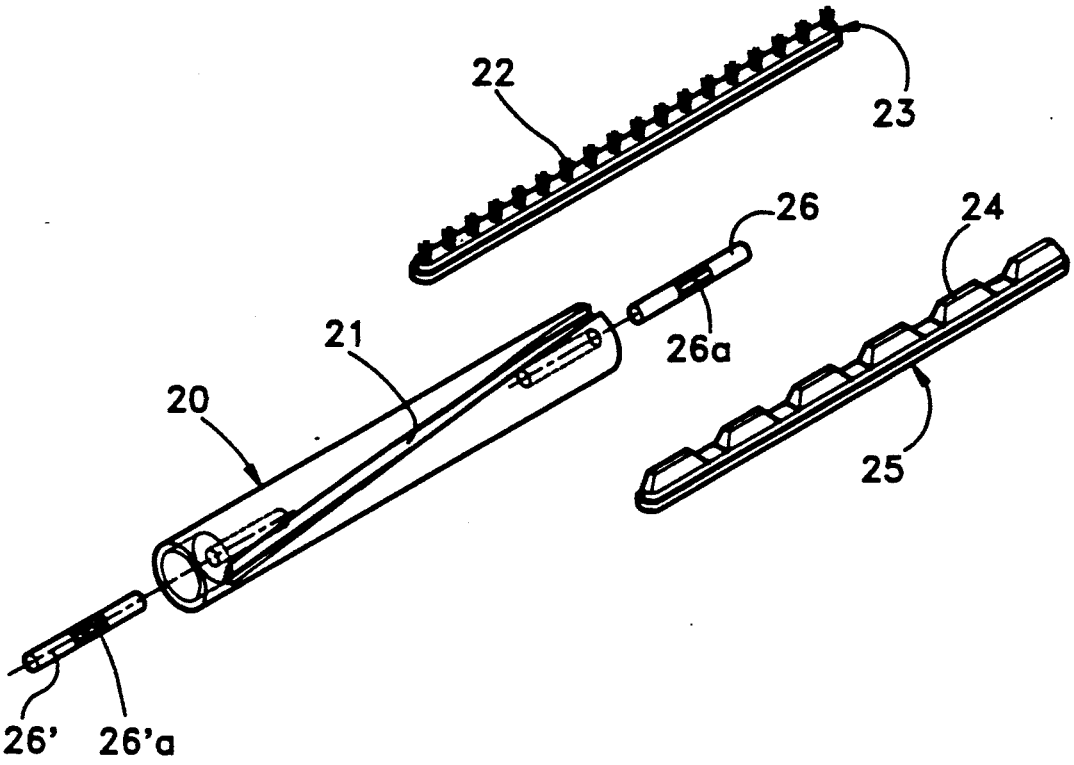
FIG. 3 PRIOR ART
FIG. 3 is an exploded perspective view representing the structure of a beater brush roller of the nozzle of FIG. 2.
Figure 4:
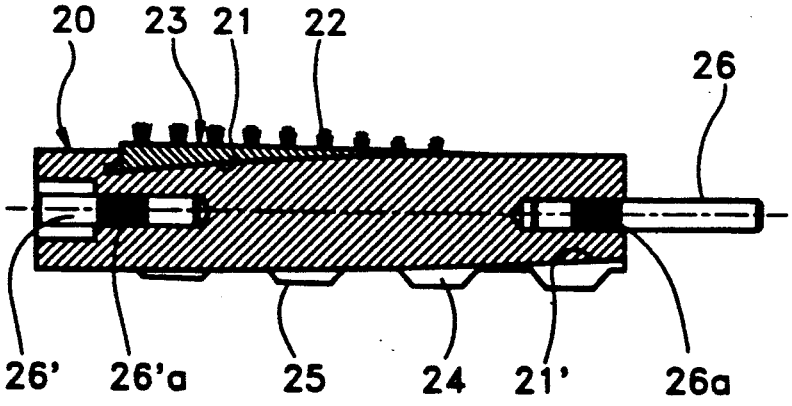
FIG. 4 PRIOR ART
FIG. 4 is a longitudinal sectioned view representing the structure of the beater brush roller of FIG. 3, after assembling.

The beater brush roller of the above structure is, instead of the roller 20 shown in FIG. 4, combined with the beater brush assembly of the nozzle of FIG. 2 in order to accomplish the vacuum cleaner beater brush assembly.

As described above, the beater brush roller in accordance with the present invention provides advantage in that it comprises the semi-cylindrical brush body and the semi-cylindrical beater body including, on respective circumferential surface thereof, the helical brush strip having a plurality of brush bundles and integrally formed with the brush body, and the helical beater strip having a plurality of rigid beater projections and integrally formed with the beater body, thereby accomplishing the simple structure and facilitating the assembling thereof. Also, the roller has another advantage in that the axles thereof are naturally fixed to the body assembly, comprising the brush body and the beater body, without any fitting force during the assembling of the roller, thereby causing the fixing of the axles to be more facilitated and also preventing the crack of the roller body which may occur due to the fitting force for fitting the axles to the roller body.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A beater brush roller of a vacuum cleaner beater brush assembly comprising:

a body assembly comprising:

a semi-cylindrical brush body including a helical brush strip integrally provided on a circumferential surface thereof, said brush strip including a plurality of brush bundles; and a semi-cylindrical beater body including a helical beater strip integrally provided on a circumferential surface thereof, said beater strip including a plurality of rigid beater projections;

a pair of axles engaging with bearing mounts of said beater brush assembly for supporting rotation of said beater brush roller, said axles mounted to opposite ends of said body assembly under the condition that it is prevented from moving with respect to said body assembly;

means for supporting said axles at opposite ends of said body assembly, said means integrally formed with said brush body and said beater body; and means for combining said brush body with said beater body in order to accomplish said body assembly, said axles disposed between said brush body and said beater body and said means for combining said brush body and said beater body engaging with said axles at respective rear ends of said axles.

2. A beater brush roller of a vacuum cleaner beater brush assembly according to claim 1, further comprising:

a pair of bosses provided to said brush body at positions of a distance from said means for supporting said axles, a pair of bosses provided to said beater body at positions corresponding to said positions of said bosses of said brush body, and holes provided to said axles at rear ends thereof, respectively; and wherein said means for combining said brush body and said beater body engages with said bosses of the brush body and said bosses of the beater body and said holes of the axles.

3. A beater brush roller of a vacuum cleaner beater brush according to claim 1 or 2, wherein said means for supporting said axles comprises annular supports of reduced inner diameter portions having a width and integrally formed with said brush body and said beater body, said annular supports formed at positions of a distance from ends of said brush and beater bodies and at the other ends of said bodies, respectively.

* * * * *